US011852112B2

(12) United States Patent
Tower et al.

(10) Patent No.: US 11,852,112 B2
(45) Date of Patent: Dec. 26, 2023

(54) FUEL INJECTOR WITH INTERNAL FILTER ELEMENT

(71) Applicant: Caterpillar Inc., Peoria, IL (US)

(72) Inventors: Benjamin R. Tower, Varna, IL (US); Daniel R. Ibrahim, East Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 215 days.

(21) Appl. No.: 17/103,223

(22) Filed: Nov. 24, 2020

(65) Prior Publication Data

US 2022/0163009 A1 May 26, 2022

(51) Int. Cl.

| | |
|---|---|
| ***F02M 61/16*** | (2006.01) |
| ***F02M 55/00*** | (2006.01) |
| ***F02M 61/18*** | (2006.01) |
| ***F02M 55/02*** | (2006.01) |

(52) U.S. Cl.

CPC ..... *F02M 61/165* (2013.01); *F02M 55/008* (2013.01); *F02M 55/025* (2013.01); *F02M 61/1806* (2013.01); *F02M 2200/27* (2013.01)

(58) Field of Classification Search

CPC ..... F02M 2200/27; F02M 55/008; F02M 47/027; F02M 55/025; F02M 61/165; F02M 61/1806

See application file for complete search history.

(56) References Cited

U.S. PATENT DOCUMENTS

| | | | | |
|---|---|---|---|---|
| 7,278,593 | B2 | 10/2007 | Wang et al. | |
| 7,673,817 | B2 * | 3/2010 | Brauneis | F02M 55/002 239/584 |
| 10,371,110 | B2 * | 8/2019 | Brown | F02M 61/165 |
| 10,941,742 | B2 * | 3/2021 | Brown | F02M 53/043 |
| 2003/0052052 | A1 * | 3/2003 | Boast | F02M 51/0667 210/429 |
| 2009/0121049 | A1 | 5/2009 | Flynn et al. | |
| 2010/0096473 | A1 | 4/2010 | Coldren et al. | |
| 2010/0174467 | A1 | 7/2010 | Ibrahim | |
| 2012/0160762 | A1 * | 6/2012 | Kimura | B01D 29/112 210/432 |
| 2013/0248612 | A1 | 9/2013 | Ayanji et al. | |
| 2015/0008271 | A1 * | 1/2015 | Mack | F02M 61/168 29/428 |
| 2015/0041565 | A1 * | 2/2015 | Mueller | F02M 61/165 239/575 |
| 2016/0220926 | A1 * | 8/2016 | Caceres | F02M 61/165 |
| 2017/0009718 | A1 * | 1/2017 | Caceres | F02M 61/165 |
| 2017/0051712 | A1 * | 2/2017 | Sauvetre | F02M 61/165 |
| 2019/0063386 | A1 | 2/2019 | Brown | |

FOREIGN PATENT DOCUMENTS

JP 2006-336594 A 12/2006

* cited by examiner

*Primary Examiner* — Carl C Staubach
(74) *Attorney, Agent, or Firm* — Brannon Sowers & Cracraft PC

(57) ABSTRACT

A fuel injector for a common rail fuel system includes an energizer section, an injector section, and control section axially disposed along an injector axis. To control and injection event, the control section includes a control orifice manifold that has a plurality of control orifices and control passages to distribute high pressure fuel with the injector assembly. To prevent plugging of the control orifices and passages, an internal filter element with a plurality of filtration orifices is located in proximity to the control orifice manifold.

16 Claims, 6 Drawing Sheets

FUEL INJECTOR WITH INTERNAL FILTER ELEMENT

TECHNICAL FIELD

The present disclosure relates generally to a fuel system for supplying fuel to an internal combustion engine and, more particularly, to a fuel injector for receiving high pressure fuel from a common fuel rail and injecting the high pressure fuel to a combustion chamber.

BACKGROUND

A variety of fuel systems have been developed that use different operating characteristics and technologies to delivery fuel to the combustion chambers of an internal combustion engine. One example is a unit injection system in which the individual unit fuel injectors associated with the combustion chambers of the internal combustion engine each include an individual pumping mechanism that may be actuated by the same camshaft that opens and closes the intake and exhaust valves. The timing of the injection events is therefore synchronized with the introduction of intake air into the combustion chamber and removal of exhaust gasses from the combustion chamber. However, because the pumping mechanism included with unit fuel injectors, typically a plunger type pump, is dependent upon camshaft rotation to actuate, the timing and number of injections are invariable and cannot be adjusted. Additionally, the fluid pressures generated and the fuel quantities delivered by the unit fuel injectors are often limited due to the size and mechanics of the injector.

To improve fuel efficiencies and engine emissions, more recent fuel systems have been developed to introduce high pressure fuel to the combustion chambers in multiple, rapid injection events. To provide the high pressure fuel, all fuel injectors are supplied by a distribution system, or common fuel rail, which functions as a pressure accumulator to retain highly pressurized fuel from a high pressure pump. The individual fuel injectors can be electromechanical devices with relatively complex designs and many interoperating parts that can be precisely controlled to selectively adjust the timing, duration, and number of injection events. However, to operate under the harsh conditions associated with common rail fuel delivery systems, including high pressures, temperatures, and rapid changes to the operational parameters, the fuel injectors are often machined to tight tolerances and robustly assembled.

To protect against deterioration or failure of the complex common rail fuel filters, it is desirable for the fuel to be substantially clean and free of impurities. While fuel filters disposed upstream of the common rail can do a great deal to accomplish this, it has been suggested that additional particulate removal structures can also be associated with the individual fuel injectors. For example, U.S. Pat. No. 10,371,110 (the '110 patent), assigned to the present Applicant, describes a fuel injector for use with a common rail system in which the body of the fuel injector incorporates a perforation array. As high pressure fuel passes into the fuel injector through the injector body, the perforation array can remove any contaminants or particulates remaining in the fuel. The present disclosure is similarly directed to filtering highly pressurized fuel received by individual fuel injectors that may be used with a common rail fuel system.

SUMMARY OF THE INVENTION

In one aspect, the disclosure provides a fuel injector that includes an energizer section and an injector section axially disposed along an injector axis. To initiate an injection event, the energizer section includes an electrical actuator such as a solenoid or piezoelectric element. The injector section includes a nozzle casing that defines a nozzle chamber with a nozzle check valve accommodated therein and configured to axially move with respect the injector axis to selectively seal and unseal a nozzle outlet disposed through a closed end of the nozzle casing. To receive high pressure fuel from a fuel source, the fuel injector includes a high pressure inlet passage and to return low pressure fuel to the fuel source, the fuel injector includes a low pressure drain passage. The fuel injector also includes a control orifice manifold in fluid communication with the high pressure inlet passage and the low pressure drain passage with a plurality of control orifices and a plurality of control passages associated with the plurality of control orifices which direct the flow of fuel through the fuel injector. To protect the control orifices from clogging, an internal filter element is disposed proximately around the control orifice manifold. The internal filter element includes a plurality of filtration orifices arranged to filter high pressure fuel flowing between the high pressure inlet passage and the control orifice manifold.

In another aspect, the disclosure provides a fuel system for an internal combustion engine that includes a fuel reservoir accommodating low pressure fuel, a high pressure fuel pump in fluid communication with the fuel reservoir to pressurize low pressure fuel, and a common fuel rail in fluid communication with and downstream of the high pressure fuel pump to receive high pressure fuel. To introduce high pressure fuel to the internal combustion engine, the fuel system also includes a plurality of fuel injectors each in fluid communication with the common fuel rail and each operatively associated with a combustion chamber of the internal combustion engine. The fuel injectors each include an injector section accommodating a nozzle check valve in a nozzle chamber to seat and unseat a nozzle outlet and an energizer section with an electrical actuator to initiate an injection event. To receive high pressure fuel, the fuel injectors each include a high pressure inlet passage in fluid communication with the common fuel rail and to return low pressure fuel to the fuel reservoir, the fuel injectors each include a low pressure drain passage communicating with the reservoir. To control and direct the flow of fuel, the fuel injectors include a control orifice manifold located between the injector section and the energizer section that is in fluid communications with the high pressure inlet passage and the low pressure drain passage. The control orifice manifold includes a plurality of control orifices and a plurality of control passages to selectively receive and direct the flow of high pressure fuel from the high pressure inlet passage. To protect the control orifices from clogging, an internal filter element is disposed around the control orifice manifold and includes a plurality of filtration orifices arranged to filter high pressure fuel flowing from the high pressure inlet passage to the control orifice manifold.

In still another aspect, the disclosure provides a fuel injector including an energizer section, a control section, and an injector section axially disposed along an injector axis. To initiate an injecting event, the energizer section including an electrical actuator such as a solenoid or piezoelectric element. The injector section includes a nozzle casing that defines a nozzle chamber with a nozzle check valve therein configured to axially move with respect to the injector axis to seal and unseal a nozzle outlets disposed in the closed end of the nozzle casing. To receive high pressure fuel, the fuel injector includes a high pressure inlet passage receiving disposed at a partly axial orientation with respect to the injector axis. To return low pressure fuel to a fuel source, the fuel injector includes a low pressure drain passage. To control and direct the flow of fuel, the fuel injector includes a control orifice manifold axially aligned with the injector axis and in fluid communication with the high pressure inlet passage and the low pressure drain passage. The control orifice manifold includes a plurality of control orifices and an associated plurality of control passages that receive high pressure fuel from the high pressure inlet passage. To protect the control orifices and control passages from clogging, an internal filter element is disposed proximately around the control orifice manifold. The internal filter element includes an annular filter wall disposed concentrically around the control orifice manifold and a plurality of filtration orifices dispose through the filter wall that are radially oriented and perpendicular to the injector axis. The internal filter element filters the high pressure fuel flowing between the partially axial high pressure inlet passage and the control orifice manifold.

DETAILED DESCRIPTION

Figure 1:
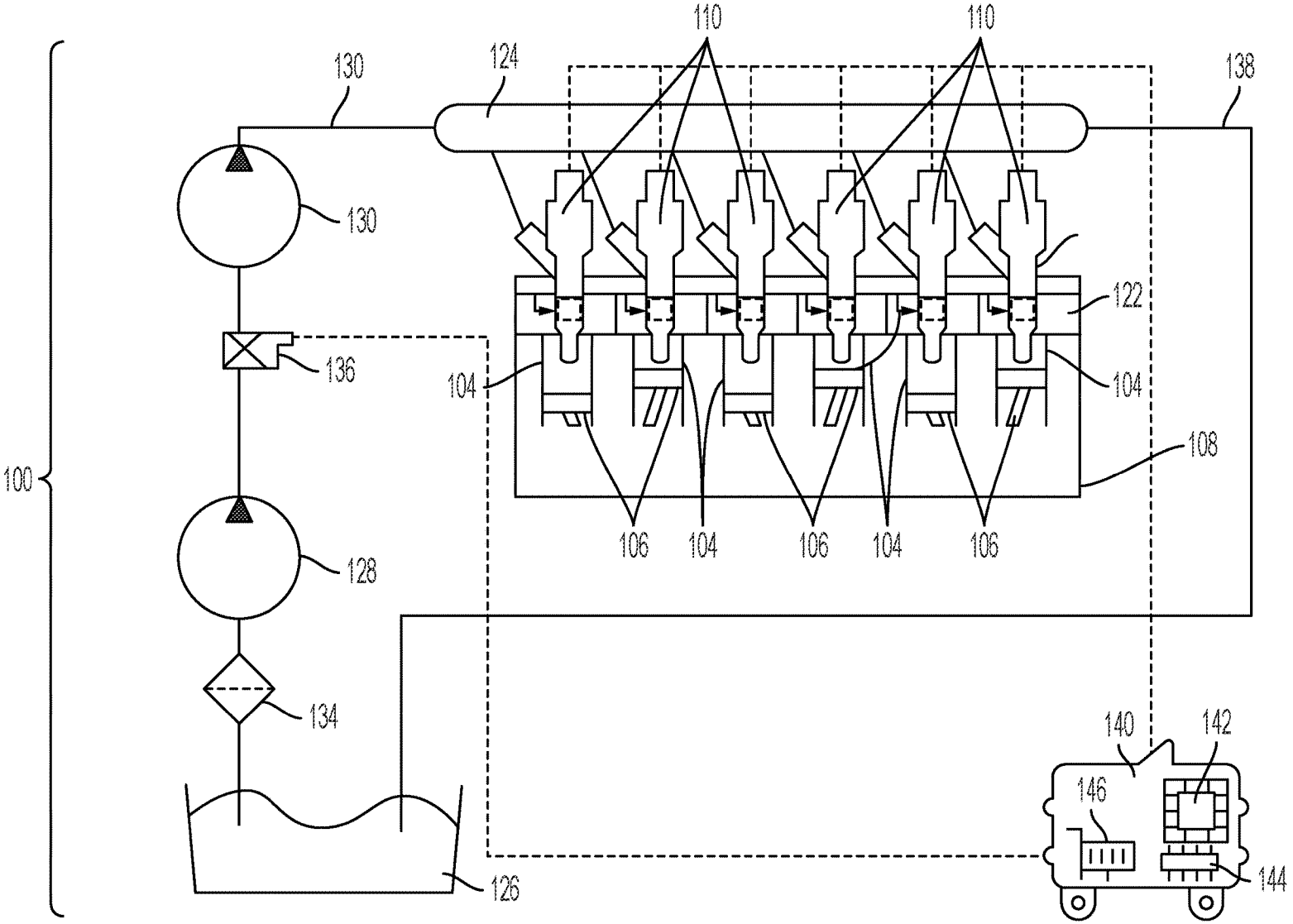
FIG. 1 is a schematic illustration of a common rail fuel system utilizing fuel injectors designed in accordance with the present disclosure.

Now referring to the figures, wherein like reference numbers refer to like elements, there is illustrated in FIG. 1 a fuel system 100 for delivering a hydrocarbon-based fuel to an internal combustion engine 102. The internal combustion engine 102 includes a plurality of combustion chambers 104 or cylinders accommodating linearly moveable pistons 106 which are disposed in an engine block 108 where the fuel can be combusted to convert the chemical energy associated with the fuel to motive mechanical power. The linearly reciprocal power may be controverted to rotational motion and harnessed and transferred from the internal combustion engine 102 by a crankshaft (not shown). In an embodiment, the internal combustion engine 102 can be a diesel-burning, compression ignition engine, although aspects of the disclosure may be applicable to other types of engines.

To introduce fuel to the plurality of combustion chambers 104, the fuel system 100 includes a respective plurality of fuel injectors 110, each of which are supported in an engine head 122 extending over and mounted to the engine block 108. The fuel injectors 110 are disposed or arranged in the engine head 122 so as to be in fluid communication with the combustion chambers 104 and, in an embodiment where the fuel system 100 is of a direct injection configuration, the fuel injectors 110 are directly exposed to the respective combustion chambers 104. The engine head 122 may also include an air intake manifold and an exhaust manifold to respectively deliver intake air to the combustion chambers 104 and remove exhaust gasses therefrom.

In the illustrated embodiment, the fuel system 100 may be a common rail system in which the plurality of fuel injectors 110 receive fuel maintained at a fluid pressure significantly higher than atmospheric from a common fuel rail 124 or similar high pressure accumulator. Accordingly, "common rail" as used herein refers to any number of different fuel containment and supply strategies wherein a single pressurized fuel reservoir is employed to maintain fuel at a desired pressure for supplying multiple fuel injectors 110. The common fuel rail 124 can be a separate fluid vessel disposed above the engine head 122, although in other embodiments it may be configured as internal passages disposed through the engine head 122.

To accommodate a supply of fuel for combustion, the fuel system 100 can include a fuel reservoir 126 or fuel tank that may be typically maintained at atmospheric pressure. To pressurize and transfer the fuel from the low pressure fuel reservoir 126 to the common fuel rail 124, the fuel system 100 can have a plurality of pumps including a low pressure fuel transfer pump 128 and a higher pressure pressurization pump 130 fluidly communicating through a fuel supply conduit 132. The fuel pressurization pump 130 can be configured to raise the pressure of the fuel to the desired fluid pressure, which for example may be on the order of several hundred mega-pascals. The fuel supply conduit 132 can be a hose, piping, etc. which has a bursting strength sufficient to communicate the high pressure fuel. The fuel system 100 can include other components and features such as fuel filters 134 and pressure relief valves 136 to assist in operation. In an embodiment, the fuel system 100 can be configured for continuous circulation wherein unburned fuel in the common fuel rail 124 can be returned to the fuel reservoir 126 by a lower pressure fuel drain line 138.

To coordinate and regulate operation of the internal combustion engine 102 and its associated systems, an electronic controller 140, which may also be referred to as an engine control module (ECM) or an engine control unit (ECU), may be operatively associated with the engine and may be disposed onboard the machine that the engine powers. The electronic controller 140 can be a programmable computing device and can include one or more microprocessors 142, a non-transitory computer readable and/or writeable memory 144 or a similar storage medium, input/output interfaces 146, and other appropriate circuitry for processing computer executable instructions, programs, applications, and data to regulate performance of the engine 102. The electronic controller 140 may be configured to process digital data in the form of binary bits and bytes. In an embodiment, the microprocessors 142 and other circuitry can be a preprogrammed, dedicated device like an application specific integrated circuit (ASIC) or a field programmable gate array (FPGA). Although in the illustrated embodiment the electronic controller 140 is depicted as a single device, in other embodiments the operation and functionality associated with the electronic controller can be distributed among a plurality of devices.

The electronic controller 140 can communicate with various sensors to receive data about engine performance and operating characteristics and can responsively control various actuators to adjust that performance. To send and receive electronic signals in order to input data and output commands, the electronic controller 140 can be operatively associated with a communication network having a plurality of terminal nodes connected by data links or communication channels. For example, as will be familiar to those of skill in the art of automotive technologies, a controller area network ("CAN") can be utilized that is a standardized communication bus including physical communication channels conducting signals conveying information between the electronic controller and the sensors and actuators associated with the internal combustion engine 102.

Figure 2:
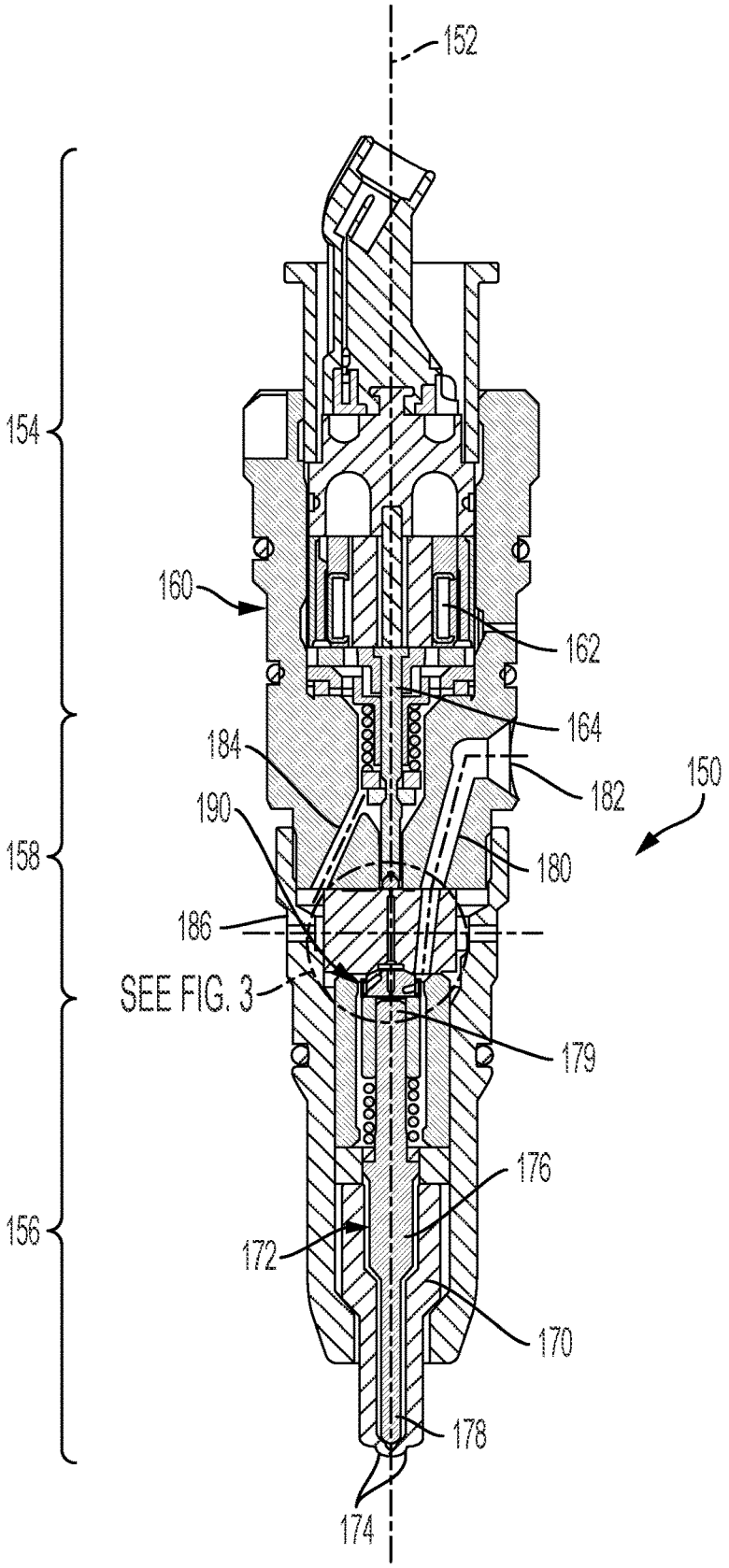
FIG. 2 is a cross-sectional view of a fuel injector illustrating the internal components allocated among an energizer section, an injector section, and control section.

Referring to FIG. 2, the fuel injector 110 can be formed as an elongated injector assembly 150 that is disposed along an injector axis 152. In the illustrated embodiment, the exterior of the injector assembly 150 may taper from one axial end toward an opposite second axial end. The injector assembly 150 may include multiple parts including stationary or fixed structures and movable components that interact to receive high pressure fuel from the common rail and eject pulsed shots or doses of the high pressure fuel to the combustion chambers. To facilitate cooperative interaction of the fixed structures and movable components, the multiple parts and different functionalities of the injector assembly 150 can be considered as assigned to an energization section 154, an injector section 156, and a control section 158 that are axially arranged along the injector axis 152 with control section intermediately disposed between the energization section and the injector section.

To energize the injection assembly 150 and initiate an injection, the energization section 154 can include an electric actuator 160 such as an electromagnetic solenoid or piezo-crystalline drive located toward one axial end of the injector assembly 150. In an embodiment, the electric actuator 160 may include a solenoid coil 162 that may be generally annular and concentric with respect to the injector axis 152. The solenoid coil 162 further many be considered a fixed structure fixed in axial position with respect to the injector axis 152. An armature 164 can be inserted through the annular solenoid coil 162 and may be a movable component adapted to linearly move along the injector axis 152. The armature 164 further can be biased toward or away from the solenoid coil 162 by a solenoid spring 166. The electric actuator 160 may be in operative communication with the electronic controller described above to selectively energize and de-energize the electromagnetic solenoid coil 162. Upon energization and/or de-energization, the armature 164, which may be made of a magnetic material, can responsively move along the injector axis 152 either into or away from the annular solenoid coil 162.

To selectively eject high pressure fuel from the injector assembly 150, the injector section 156 can be operatively responsive to energization and de-energization of the energization section 154. The injector section 156 can include an elongated, hollow nozzle casing 170 that is constructed as a single or multiple part fixed structure of the injector assembly 150. The hollow nozzle casing 170 can define a lumen or bore that functions as an internal nozzle chamber 172 and which is axially aligned with the injector axis 152. The hollow nozzle casing 170 can further be closed at one axial end into which can be disposed one or more nozzle outlets 174 that enable fluid communication between the internal nozzle chamber 172 and the exterior of the injector section 156. To selectively seal and unseal the nozzle outlets 174, a nozzle check valve 176 can be movably disposed in the nozzle chamber 172 and can be aligned with and linearly movable along the injector axis 152. In an embodiment, the nozzle check valve 176 can have an elongated structure including a distal sealing end 178 shaped to mate with the closed end of the nozzle casing 170 and oriented toward a second axial end of the injector assembly 150 and a proximal pressure end 179 oriented toward the control section 158.

To facilitate operative interaction between the energizer section 154 and the injector section 156, the control section 158 is disposed axially between the energizer section and the injector section and includes fixed structures and movable components to selectively direct fluid flow through the injector assembly 150 via a plurality of selectively interconnected fluid passages. As used herein, "fluid passages" refer to the internal channels for conducting or directing fuel internally through the injector assembly and which can be oriented or arranged in various axial and/or radially directions through the body of the injector assembly 150. The control section 158 utilizes a portion of the high pressure fuel as an operative medium to control and conduct the injection event.

For example, to initially receive high pressure fuel, the injector assembly 150 can include or have defined therein a high pressure inlet passage 180. The high pressure inlet passage 180 may include a radially oriented inlet port 182 located approximately axial mid-length of the injector assembly 150 and can be in fluid communication with the common fuel rail or similar upstream fluid source. The high pressure inlet passage 180 can direct pressurized fluid to the internal nozzle chamber 172 disposed toward the second axial end of the injector assembly 150 where the pressured fuel can be accommodated until an injection event. Where the fuel system is configured for continuous circulation, the injector assembly 150 can also include one or more low pressure drain passages 184 that communicate with the exterior of the injector assembly via radially oriented drain ports 186 that can be in fluid communication with the external fuel drain line.

Figure 3:
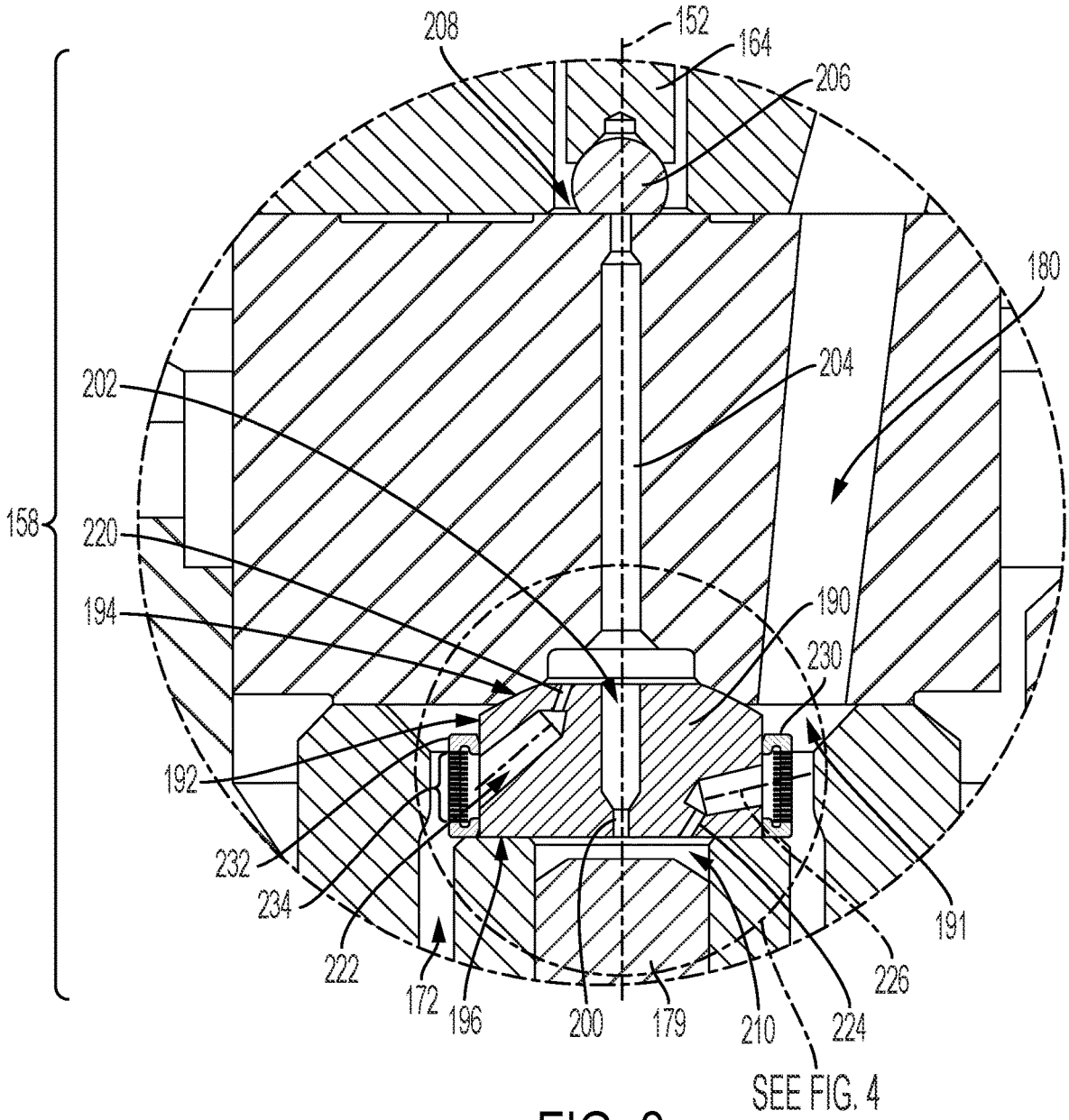
FIG. 3 is a detailed view of an internal filter element supported in a closely proximate relation to a control orifice manifold that distributes fuel to a plurality of passages to control an injection event.

To control and direct fuel flow between the high pressure inlet passage 180, the internal nozzle chamber 172, and the low pressure drain passages 184, the control section 158 can include a control orifice manifold 190. Referring to FIG. 3, the control orifice manifold 190 can be a generally disk-shaped object centrally aligned with the injector axis 152 and that can be partially located in or exposed to the internal nozzle chamber 172. In particular, the axial region of the internal nozzle chamber 172 in which the control orifice manifold 190 is located may be referred to as the high pressure inlet region 191 which fluidly communicates with the high pressure inlet passage 180 of the injector assembly 150 and which receives pressurized fuel therefrom. The high pressure inlet region 191 is the axial terminuses of the high pressure inlet passage 180 opposite the axially distant inlet port 182.

To assume the disk-shape, the control orifice manifold 190 can include a cylindrical peripheral surface 192 extending concentrically around the injector axis 152 that is axially bound between an upper or first axial manifold face 194 and a lower, second axial manifold face 196. In the illustrated embodiment, the first axial manifold face 194 need not be entirely perpendicular to the injector axis 152 but may taper or curve toward the peripheral surface 192.

Disposed into the peripheral surface 192 and the first and second axial faces 194, 196 can be a plurality of control orifices that fluidly communicate with internal control passages disposed through the control orifice manifold. In the illustrated embodiment, to restrict the uninhibited flow of fuel to different fluid passages while accommodating sufficient fuel in the control orifice manifold 190, the control orifices may have a smaller diameter than the control passages and may function as restrictors, but in other embodiments they may be of the same diameter.

By way of example, the control orifice manifold 190 can include a check control orifice 200 and a respective check control passage 202 disposed between the first and second axial manifold faces 194, 196 which are centrically aligned with the injector axis 152. The check control orifice 200 and check control passage 202 can establish fluid communication with a first control valve passage 204 extending axially away from the upper or first axial manifold face 194 along the injector axis 152 and which is disposed through other fixed structures of the control section 158. The axial end of the first control valve passage 204 may be sealed by a control valve 206, that can be normally biased against a valve seat 208 operatively arranged around the control valve passage. The control valve 206 can take any suitable shape such as a ball valve or flat disk. To hold the control valve 206 against the valve seat 208, the control valve may be directly or indirectly pressed there against by the armature 164 when the electric actuator is in the un-energized state.

The check control orifice 200 and check control passage 202 can also be in fluid communication with a check control sub-cavity 210 that is disposed axially below the lower or second axial manifold face 196. The check control sub-cavity 210 can be an isolated region of the internal nozzle chamber 172. The check control sub-cavity can also be axially bounded by the proximal pressure end 179 of the nozzle check valve. Accordingly, the first control valve passage 204 and the check control sub-cavity 206 are axially separated by the control orifice manifold 190 with fluid communication there between established by the check control orifice 200 and the first control valve passage 204.

Additionally, the control orifice manifold 190 can include a control valve orifice 220 that is disposed into the upper or first axial manifold face 194 and that communicates with a second control valve passage 222 that is disposed through the peripheral surface 192 of the control orifice manifold 190. The control valve orifice 220 and second control valve passage 222 are not parallel or perpendicular to the injector axis 152, but instead are disposed at angles in to the injector axis. The control orifice manifold 190 can include a sub-cavity orifice 224 disposed into the lower or second axial manifold face 196 and that fluidly communicates with a sub-cavity passage 226 also disposed at an angle through the peripheral surface 192. The sub-cavity orifice 224 and sub-cavity passage 226 establish fluid communication between the high pressure inlet region 191 and the check control sub-cavity 210.

As described below, the second control valve passage 222 and the sub-cavity passage are not disposed perpendicularly into the peripheral surface 192 or perpendicular to the injector axis 152, but instead angle towards the first axial manifold face 194 and/or second axial manifold face 196 respectively. While the control valve orifice and second control valve passage 220, 222 and the sub-cavity orifice and passage 224, 226 are illustrated as a radially symmetric and opposed pair, different combinations and arrangements are contemplated.

Referring to FIGS. 2 and 3, the high pressure inlet region 191 can receive high pressure fuel from the high pressure inlet passage 180 and direct a portion of the fuel to the internal nozzle chamber 172 where it is accommodated until an injection event occurs. Some of the pressured fuel is also directed from the high pressure inlet region 191 to the control valve orifice 220 via the second control valve passage 222 disposed in the peripheral surface 192. That portion of the pressurized fuel is maintained in the first control valve passage 204 by the control valve 206 biased by the armature 164 to seal the axial end of the primary control valve passage. A portion of the high pressure fuel is also directed from the high pressure inlet region 191 to the check control sub-cavity 210 via the sub-cavity passage 226 and sub-cavity orifice 224. The presence of high pressure fuel in the check control sub-cavity 210 axially biases the proximal pressure end 179 of the nozzle check valve 176 away from the lower or second axial manifold face 196 in a manner that seals the nozzle outlets 174.

To initiate an injection event, the electrical actuator 160 is energized axially pulling the armature 164 into the solenoid coil 162 by magnetic attraction. This axially moves the control valve 206 away from the valve seat 208 unsealing the first control valve passage 204. Pressurized fuel maintained in the first control valve passage 204 can flow to the low pressure drain passage 184 relieving fluid pressure in the control valve passage. Because the first control valve passage 204 communicates with the check control sub-cavity 210 through the check control orifice 200 and check control passage 202, high pressure fuel in the check control sub-cavity is removed, thereby lowering the fluid pressure in the check control sub-cavity 210. This allows the proximal pressure end 179 of the nozzle check valve 176 to axially move towards the lower or second axial manifold face 196 in a manner that unseals the nozzle outlets 174. The high pressure fuel previously accommodated in the internal nozzle chamber 172 exits under pressure through the nozzle outlets 174 resulting in an injection event.

Because the high pressure fuel directed though the control orifice manifold 190 to accomplish the injection event may include particulates or contaminants, an internal filter element 230 can be positioned proximate the control orifice manifold to protect the control orifices therein from plugging or becoming obstructed. For example, referring to FIG. 4, the internal filter element 230 can be disposed about the control orifice manifold 190 and can be directly or indirectly supported in concentric arrangement around the cylindrically-shaped peripheral surface 192. When located around the peripheral surface 192, the internal filter element 230 is positioned between the high pressure inlet region 191 upstream and the control orifices and passages in the control orifice manifold 190 downstream ensuring that any high pressure fuel flowing through the control section 158 of the injector assembly 150 is filtered. The internal filter element 230 is also generally located in the high pressure inlet region 191 and thus internally of the exterior of the fuel injector assembly 150.

To enable filtered fuel flow between the high pressure inlet region 191 and the control orifice manifold 190, the internal filter element 230 can include an annular filter wall 232 with a plurality of filtration orifices 234 disposed through it. When supported in a proximate relation to the control orifice manifold 190, the annular filter wall 232 is generally parallel and concentric to the peripheral surface 192 and the filtration orifices 234 are radially perpendicular to the peripheral surface 192 and the injector axis 152. Further, the annular filter wall 232 surrounds the second control valve passage 222 and the sub-cavity passage 226 disposed in the peripheral surface 192, which are the exclusive flow paths from the high pressure inlet region 191 to the smaller diameter control valve orifice and sub-cavity orifice 220, 224 in the control orifice manifold 190.

In an embodiment, the filtration orifices 234 may be sized on the order of 0.03 to 0.06 millimeters in diameter. These dimensions may be sufficient to allow pressurized fuel in a fluid or liquid state to pass through the annular filter wall 232 while retaining any larger particulates that may assumedly be contaminants within or adjacently against the entrances to filtration orifices. In other embodiments, the sizes of the filtration orifices may be larger or smaller depending upon operational conditions, structural conditions, etc.

Figure 4:
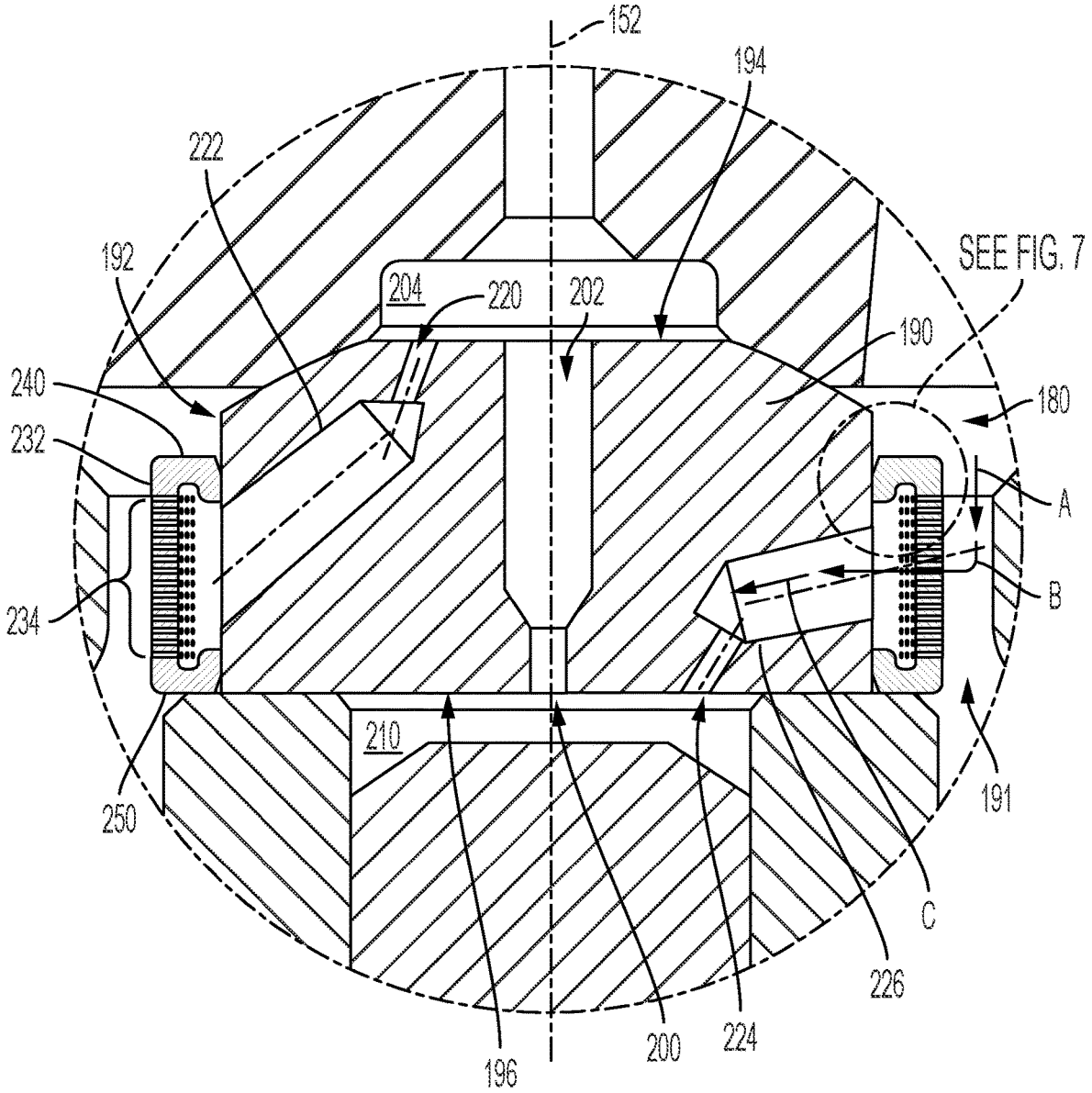
FIG. 4 is a further detailed view of the internal filter element and the control orifice manifold with an annular filter wall of the internal filter element in a spaced relation with the peripheral surface of the control orifice manifold.

In an embodiment, the annular filter wall 232 and filtration orifices 234 therein may be sized and arranged to provide what may be referred to as two-dimensional filtration. Referring to FIG. 4, pressurized fuel enters into the high pressure inlet region 191 from the high pressure inlet passage 180. Due to the partly axial orientation of the high pressure inlet passage 180 in the injector assembly, the inflowing high pressurize fuel may be generally aligned in an axial direction with respect to the injector axis 152, as indicated by Arrow A. The inflowing high pressure fuel must reorient to enter the radially arranged filtration orifices 234 in the annular filter wall 192, which are also perpendicular to the injector axis 152, as indicated by Arrow B. Further, because the second control valve passage 222 and the sub-cavity passage 226 in the control orifice manifold 190 are angled with respect to the injector axis 152, pressurized fuel flowing radially through the annular filtration wall 232 can again reorient, as indicated by Arrow C. The compounded redirection of pressurized fuel cause particulates larger than the filtration orifices 234 to be blocked by the internal filter element 230 and increases the likelihood that smaller, longer particulate will become trapped in the filtration orifices 234 and will not pass through the internal filter element 230.

To sustain filtration over the life of the internal filter element 230, it is necessary that a sufficient number of filtration orifices 234 are included in the annular filter wall 232. As the filtration orifices 234 become obstructed with particulates, the volume of pressurized fuel flowing across the annular filtration wall decreases. Accordingly, to ensure that a sufficient volume of fuel can be provided to the control orifice manifold 190, it is desirable that the plurality of filtration orifices 234 have a flow-through capacity in excess of the volume of fuel that can be received by the second control valve passage 222 and the sub-cavity passage 226. In other words, there should be redundancy of filtration orifices 234 to compensate for those that will become obstructed over the life of the internal filter element 230. To accomplish this, the collective surface area of the filtration orifices 234 should exceed the combined surface area of the entrances to the second control valve passage 222 and the sub-cavity passage 226, for example, by the order of 2:1. Furthermore, because locating filtration orifices 234 directly adjacent to the peripheral surface 192 would result in blockading fuel flow through those orifices, it is desirable that the annular filter wall 232 of the internal filter element 230 is supported in a spaced relation with the peripheral surface 192.

Figure 5:
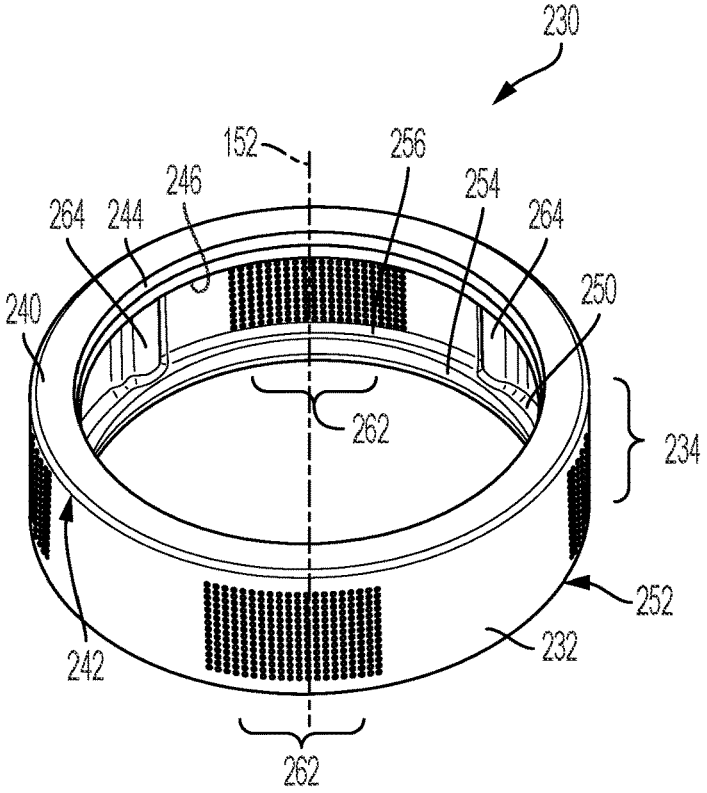
FIG. 5 is a perspective view of one embodiment of the internal filter element including an annular filter wall having first and second annular flanges designed to support the internal filter element on the control orifice manifold.
Figure 6:
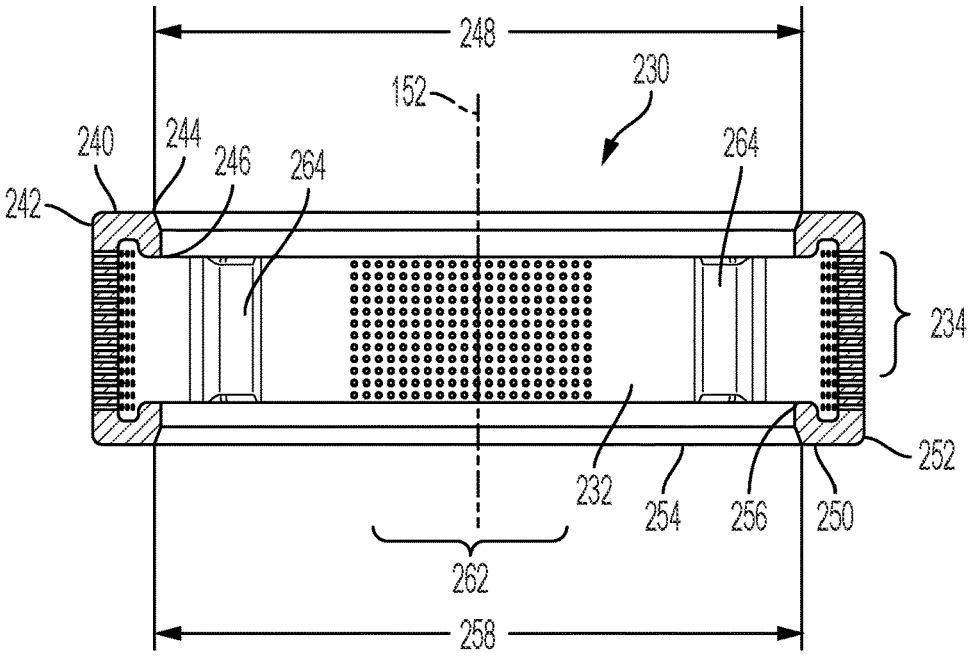
FIG. 6 is a cross-sectional view of the internal filter element of FIG. 5.

Referring to FIGS. 5 and 6, there is illustrated an embodiment of an internal filter element 230 configured to support itself on the control orifice manifold while spacing the annular filter wall 232 apart from the peripheral surface; although in other embodiments the internal filter element may be supported in a proximate relation to the control orifice manifold by other fixed structures in the control section 158. The internal filter element 230 can include a first annular flange 240 arranged perpendicular to the injector axis 152 and projecting radially inward from a first axial end 242 of the annular filter wall 232 to a first inner rim 244. The first inner rim 244 may be associated with a first flange diameter 248 and thereby reduces the inner diameter of the internal filter element 230 compared with the inner diameter associated with the annular filter wall 232. The first annular flange 240 can also include a first abutment lip 246 projecting from the first inner rim 244 to be axially parallel to and radially offset with the annular filter wall 232.

The internal filter element 230 can also include a second annular flange 250 arranged perpendicular to the injector axis 152 and projecting radially inward from a second axial end 252 of the annular filter wall 232 to a second inner rim 254. A second flange diameter 258 associated with the second inner rim 254 can equal that of the first inner rim 244, again reducing the inner diameter of the internal filter element 230 compared with the inner diameter associated with the annular filter wall 232. The second annular flange 250 can also include a second abutment lip 256 projecting from the second inner rim 254 to be axially parallel to and radially offset with the annular filter wall 232. Referring to FIG. 6, the first and second annular flanges 240, 250 and features thereof give the internal filter element 230 a general C-shaped cross-section. As illustrated in FIG. 4, when the internal filter element 230 is supported on the control orifice manifold 190, the first and second annular flanges 240, 244 contact the peripheral surface 192 while spacing the annular filter wall 232 apart from the peripheral surface 192.

The first flange diameter 248 and the second flange diameter 258 can be dimensioned to correspond with a peripheral diameter associated with the peripheral surface of the control orifice manifold. For example, referring to FIG. 4, when the internal filter element 230 is supported on the control orifice manifold 190, the first and second annular flanges 240, 250 extend radially inward to physically contact the peripheral surface 192. The first and second annular flanges 240, 250 thereby concentrically space the annular filter wall 232 radially outward from the peripheral surface 192 so that the filtration orifices 234 are not blockaded. The first and second annular flanges 240, 250 further provide an enclosed volume between the annular filter wall 232 and the peripheral surface 192 such that substantially all high pressure fuel directed to the control orifice manifold 190 flows across the plurality of filtration orifice 234 and cannot avoid filtration. In various embodiments, the internal filter element 230 can be pressed onto the control orifice manifold 190 or can be installed thereon via a clearance fit and laser welded to the control orifice manifold 190 for permanent retention.

Figure 7:
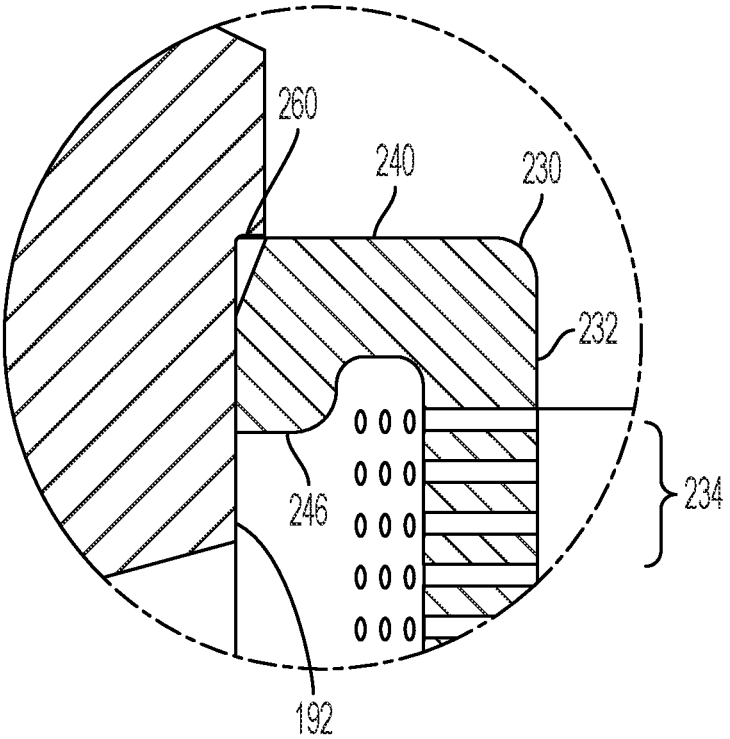
FIG. 7 is a cross-sectional view of the control orifice manifold supporting and abutting the internal filter element of FIG. 4 supported on the control orifice manifold

Referring to FIG. 7, in an embodiment to facilitate assembly, the peripheral surface 192 can be formed with a peripheral shoulder 260 or overcut projecting from the outer circumference thereof. The diameter of the peripheral shoulder 260 can be slightly larger than the flange diameters associated with the first and second annular flanges 240, 250 of the internal filter element 230. During assembly, when the internal filter element 230 is axially fitted over the control orifice manifold 190, the peripheral shoulder 260 can make abutting contact with the first annular flange 240 due to the overlapping diameters. Thus, the peripheral shoulder 260 can function as a hard stop preventing further axial movement of the internal filter element 230 and serves to guide and position the internal filter element in the correct axial location with respect to the peripheral surface 192 and the control passages disposed therein. The first abutment lip 246 can provide rigidity for abutting contact with the peripheral shoulder 260, although in other embodiments of the internal filter element 230, the abutment lips 246, 256 can be eliminated.

Referring to FIGS. 5 and 6, in an embodiment, the plurality of filtration orifices 234 in the annular filter wall 232 can be grouped and arranged in a plurality of orifice arrays 262 that are circumferentially spaced apart from each other. The number of orifice arrays 262 can correspond to the combined number of control valve passages and sub-cavity passages that are disposed in the peripheral surface of the control orifice manifold. When the internal filter element 230 is supported on the control orifice manifold, the orifice arrays 262 can be circumferentially aligned with and direct fuel flow towards the control valve and the sub-cavity passages. A possible advantage of grouping the plurality of filtration orifices 234 in orifices arrays 262 is that sufficient material is retained in the annular filter wall 232 to retain strength and stiffness characteristics of the internal filter element 230.

In a further embodiment, a plurality of support ribs 264 can be included on the inner circumferential surface of the annular filter wall 232 extending axially between the first annular flange 240 and the second annular flange 250 parallel with the injector axis 152 and located circumferentially between the plurality of orifice arrays 262. The support ribs 264 can be shaped as radially inwardly directed embossments that provide additional material between the first and second annular flanges 240, 250 for added stiffness during assembly and operation.

INDUSTRIAL APPLICABILITY

Referring to the drawings generally, the disclosure provides an internal filter element 230 that can be incorporated as an internal part of the fixed structure of a fuel injector 110 and, more particularly, can be operatively associated with the control section 158 of the injector assembly 150 to filter the high pressure fuel that is utilized as an operative medium to enable and control injection events. Incorporating the internal filter element 230 with the control section 158 advantageously locates the internal filter element 230 in close proximity with the control orifice manifold 190 that includes a plurality of control orifices having reduced diameters that are susceptible to plugging and becoming obstructed. The internal filter element 230 is therefore favorably located at the point of primary interest in avoiding obstruction or plugging of the control orifices in the control orifice manifold that facilitate operation of the fuel injector.

With particular reference to FIG. 4, the internal filter element 230 can be concentrically supported with respect to the control orifice manifold 190 centrally aligned with injector axis 152 to provide two-dimensional filtration of the high pressure fuel flowing into the control section 158 of the injector assembly 150. For example, the high pressure fuel flowing an a partially axial direction in the high pressure inlet passages 180 is reoriented through the high pressure inlet region 191 to radially flow into the plurality of radially oriented filtration orifices 234 disposed in the annular filter wall 232 of the internal filter element 230. The high pressure fuel flowing radially through the annular filter wall 232 can again be reoriented to access the second control valve passage 222 and the sub-cavity passage 226 that are disposed in the peripheral surface 192 of the control orifice manifold 190 at non-perpendicular angles with respect to the injector axis 152. Particulates larger than the filtration orifices 234 will be blocked while redirection of the high pressure fuel flow increases the probability that longer, thinner particulates will become lodged or stuck in the filtration orifices.

The geometry of the internal filter element 230 including, for example, the first and second annular flanges 240, 250 and the first and second abutment lips 246, 256 extending there from, is advantageously suitable for assembling the internal filter element via an additive manufacturing process. The plurality of filtration orifices 234, especially when grouped into orifice arrays 262, can be formed by laser drilling technologies allowing for precise control of the shape, size, and grouping of the filtration orifices into the annular filter wall. These and other possible advantages of the disclosure should be apparent from the foregoing detailed description and accompanying figures.

The present description is for illustrative purposes only, and should not be construed to narrow the breadth of the present disclosure in any way. Thus, those skilled in the art will appreciate that various modifications might be made to the presently disclosed embodiments without departing from the full and fair scope and spirit of the present disclosure. Other aspects, features and advantages will be apparent upon an examination of the attached drawings and appended claims. As used herein, the articles "a" and "an" are intended to include one or more items, and may be used interchangeably with "one or more." Where only one item is intended, the term "one" or similar language is used. Also, as used herein, the terms "has," "have," "having," or the like are intended to be open-ended terms. Further, the phrase "based on" is intended to mean "based, at least in part, on" unless explicitly stated otherwise.

What is claimed is:

1. A fuel injector comprising:

an energizer section and an injector section axially disposed along an injector axis;

the energizer section including an electrical actuator to initiate an injection event;

the injector section including a nozzle casing defining a nozzle chamber with a nozzle check valve accommodated therein configured to axially move with respect the injector axis to selectively seal and unseal a nozzle outlet disposed through a closed end of the nozzle casing, a high pressure inlet passage receiving high pressure fuel from a fuel source;

a low pressure drain passage returning low pressure fuel to the fuel source;

a control orifice manifold disposed axially between the energizer section and the injector section and in fluid communication with the high pressure inlet passage and the low pressure drain passage, the control orifice manifold including a plurality of control orifices and a plurality of control passages associated with the plurality of control orifices disposed therein receiving high pressure fuel from the high pressure inlet passage;

an internal filter element disposed proximately around the control orifice manifold, the internal filter element including an annular filter wall including an outer peripheral surface, and an inner peripheral surface, and having a plurality of filtration orifices disposed therein and arranged to filter high pressure fuel flowing between the high pressure inlet passage and the control orifice manifold;

the internal filter element further including a first flange contacting the control orifice manifold, and a second flange contacting the control orifice manifold, and the annular filter wall extending axially between the first flange and the second flange; and each of the first flange and the second flange projecting radially inward of the inner peripheral surface a projection distance, and the inner peripheral surface is spaced radially outward of the control orifice manifold a spacing distance that is equal to the projection distance.

2. The fuel injector of claim 1, wherein the annular filter wall opposes a peripheral surface of the control orifice manifold that is axially aligned with the injector axis.

3. The fuel injector of claim 2, wherein the plurality of control passages are disposed through the peripheral surface and fluidly communicate with the plurality of control orifices respectively.

4. The fuel injector of claim 3, wherein the annular filter wall and the peripheral surface are concentric.

5. The fuel injector of claim 4, wherein the first flange includes a first annular flange projecting radially inward from a first axial filter end of the annular filter wall and the second flange includes a second annular flange projecting radially inward from a second axial filter end of the annular filter wall.

6. The fuel injector of claim 5, wherein the first annular flange has a first flange diameter and the second annular flange has a second flange diameter, the first flange diameter and the second flange diameter corresponding in dimension to a peripheral diameter associated with the peripheral surface.

7. The fuel injector of claim 6, where the first annular flange and the second annular flange enclose a volume between the annular filter wall and the peripheral surface.

8. The fuel injector of claim 7, further comprising a support rib on an inner circumferential surface of the annular filter wall between the first annular flange and the second annular flange.

9. The fuel injector of claim 1, wherein the plurality of filtration orifices are grouped in a plurality of orifice arrays circumferentially spaced apart about the annular filter wall.

10. The fuel injector of claim 9, wherein the plurality of orifice arrays are circumferentially aligned with the plurality of control passages disposed through the peripheral surface.

11. The fuel injector of claim 10, wherein the plurality of orifice arrays and the plurality of control passages are located radially symmetric about the annular filter wall and the peripheral surface respectively.

12. The fuel injector of claim 1, wherein the control orifice manifold includes a peripheral surface that is cylindrical in shape and the plurality of control passages are disposed into the peripheral surface.

13. The fuel injector of claim 12, wherein the annular filter wall is concentric to and radially spaced apart from the peripheral surface.

14. The fuel injector of claim 13, wherein the first flange projects radially inward toward and contacts the peripheral surface and the second flange projects radially inward toward and contacts the peripheral surface.

15. The fuel injector of claim 14, where the first flange and the second flange enclose a volume between the annular filter wall and the peripheral surface.

16. The fuel injector of claim 1, wherein the plurality of control passages are disposed at non-perpendicular angles with respect to the injector axis through a peripheral surface that is concentric to the injector axis.

* * * * *